United States Patent [19]

Landry, Jr.

[11] 4,377,910

[45] Mar. 29, 1983

[54] CHAINSAW ATTACHMENT

[76] Inventor: Ernest A. Landry, Jr., 50 Bennett St., Lynn, Mass. 01905

[21] Appl. No.: 271,567

[22] Filed: Jun. 8, 1981

[51] Int. Cl.[3] ..... B27B 17/02

[52] U.S. Cl. ..... 30/383

[58] Field of Search ..... 30/381, 382, 383, 384; 33/185

[56] References Cited

U.S. PATENT DOCUMENTS

| | | | |
|---|---|---|---|
| 2,807,292 | 9/1957 | Gelinas | 30/383 |
| 3,276,490 | 10/1966 | Johansson | 143/32 |
| 3,364,580 | 1/1968 | Lucia | 33/185 |
| 4,185,382 | 1/1980 | Rawlinson, Jr. | 30/383 |
| 4,233,739 | 11/1980 | Hinrichs | 30/383 |
| 4,275,504 | 6/1981 | Chontos | 33/138 |
| 4,341,018 | 7/1982 | Nelson | 30/383 |

*Primary Examiner*—Jimmy C. Peters

[57] ABSTRACT

A chainsaw attachment for indicating a sawing point on a workpiece, having a support having at least two arms with grip portions clampable to the chain guide bar of the chainsaw for holding a rule substantially perpendicular to the plane of sawing with the end of the rule opposite a reference point on the workpiece. The support shown comprises two independently formed arms positioned on opposite sides of the chain guide bar, connected by a threaded connector and arranged to pivot about a fulcrum to tightly engage the chain guide bar. Each arm shown has a hole in one end slightly larger than the rule, a grip portion on the other end, and a fulcrum region between the hole end and the grip portion so arranged that when the threaded connector is tightened, the fulcrum regions bear against one another, the grip portions are drawn together to clamp the support to the guide bar, and the hole ends are forced apart causing the hole perimeters to bind against and hold a rod-form rule firmly in a selected position. Each arm is contoured to avoid interference with the chain of the chainsaw. The rule can have distance marks visible between the hole ends of the arms to permit accurate distance settings.

9 Claims, 3 Drawing Figures

CHAINSAW ATTACHMENT

BACKGROUND OF THE INVENTION

This invention relates to chainsaw attachments for indicating a point at which to saw a workpiece.

Chainsaw measuring attachments previously proposed usually are attached to the motor housing or handle of a chainsaw and cannot be attached to different models of chainsaws except by alterations (e.g., U.S. Pat. Nos. 4,233,739 (Hindrichs), 3,276,490 (Johansson), 2,807,292 (Gelinas), 4,185,382 (Rawlinson, Jr.), and 3,364,580 (Lucia)). In most cases, the measuring devices do not indicate distances from the plane of the chain guide bar, but rather from some point on the motor housing or handle, so that the location of the saw cut cannot be determined precisely with reference to the end of the measuring rule, particularly if the attachment is switched from one make of chainsaw to another. Measuring attachments generally are arranged to indicate distances only in one direction from the guide bar. The measuring rules are frequently complicated and cumbersome and therefore susceptible to damage as a result of the dirty conditions under which chainsaws are used. Some attachments measure only a fixed predetermined length. Tools are required to attach most measuring attachments to chainsaws.

SUMMARY OF THE INVENTION

In general, the invention features a rule and a support attachable to the chain guide bar of the chainsaw for holding the rule. The support has at least two arms positioned on opposite sides of the guide bar with grip portions which engage opposite sides of the guide bar. The support also has means for drawing the grip portions together to tightly grip the guide bar and to hold a rule attachment means in place. The rule attachment means holds the rule substantially perpendicular to the plane of sawing with the end of the rule opposite a reference point on the workpiece. The arms, drawing together means, and the rule attachment means are arranged to avoid contact with the chainsaw chain.

Preferably, the two arms are formed independently, each having a grip portion at one end and a fulcrum region, at a remote point from the grip portion, adapted to engage the fulcrum region of the other arm; and the drawing together means is a clamping means which causes the fulcrum regions to bear upon one another and the grip portions to tightly grip the guide bar.

Preferably, the rule is axially movable; the rule attachment means comprises, on each arm, a rule holding portion on the opposite end from the grip portion, having a rule hole slightly larger than the rule cross-section, the axes of the rule holes in the two arms being substantially in line with one another, so that when the drawing together means is tightened, the fulcrum regions bear upon one another, the grip portions tightly grip the guide bar, and the rule holding portions are spread apart causing the rule holes to bind against the surface of a rod-form rule thereby holding the rule securely in a selected position.

Preferably, each of the arms is contoured with a flat-surfaced grip portion parallel to the guide bar; first, second and third clearance portions which respectively are directed outwardly from, parallel to and inwardly to the plane of the flat-surfaced grip portion; and a rule holding portion at a small angle to that plane; such that the area of connection between the third clearance portion and the rule holding portion forms the fulcrum region, the perpendicular distance between the second clearance portion and the plane of the flat-surfaced grip portion is at least $\frac{3}{8}''$, and the arm avoids interference with the chain of the chainsaw.

The drawing together means can be a carriage bolt, a lock washer, and a hand nut which can be hand tightened. The rule can bear distance marks which can be seen between the rule holding portions of the arms to permit a precise setting of the end of the rule with respect to the plane of the sawing. Sleeves can be attached to the rule to hold it more rigidly against the support; resilient, slip-resistant pads can be attached to the grip portions to prevent slippage; and spikes can be formed on the edge of the arms facing the workpiece to provide a pivot point against said workpiece to aid in finishing a saw cut.

The chainsaw attachment can be quickly and easily attached to and removed from a chainsaw and can be switched from chainsaw to chainsaw, all without the use of tools or alterations to the chainsaws. The measuring rule can be easily and inexpensively replaced if broken, and rules of different lengths can be easily substituted. The position of the measuring rule can be simply and precisely set with reference to the plane of the guide bar, and distances can be set in either direction from the guide bar. The simplicity of the attachment minimizes the chance of its being damaged by the severe conditions of chainsaw use.

DESCRIPTION OF THE PREFERRED EMBODIMENT

Turning now to the structure and operation of the preferred embodiment, a brief description of the drawings is as follows.

DRAWINGS

Structure

Figure 1:
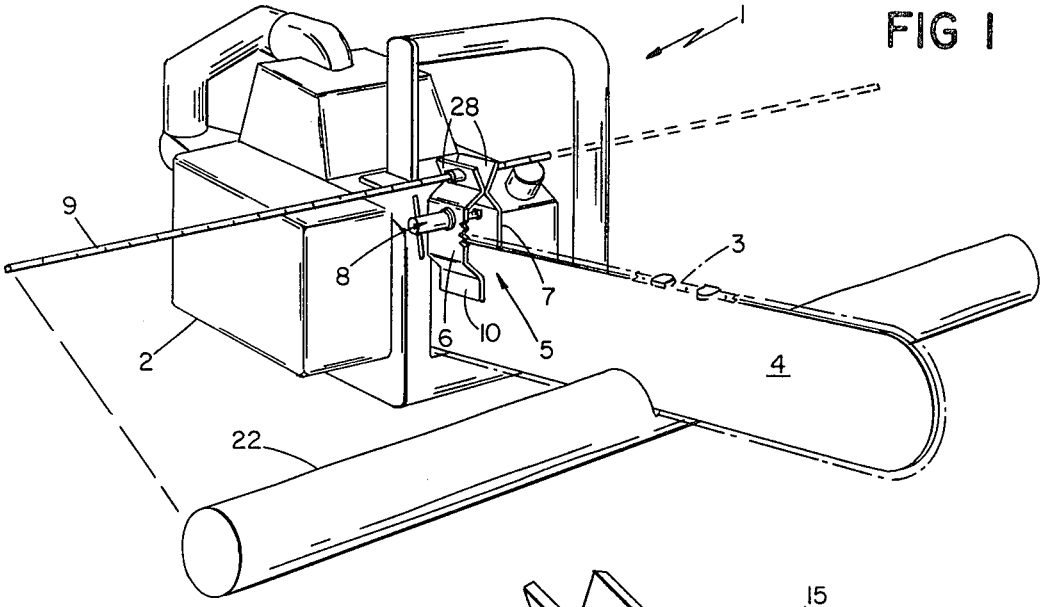
FIG. 1 is a perspective view of a chainsaw and the preferred embodiment of the attachment.

In FIG. 1, chainsaw 1 includes chainsaw motor housing 2, saw chain 3, and chain guide bar 4. Although the motor housings of different chainsaws vary substantially in size and shape, they universally employ a guide bar, in the form of a thin metal plate, supporting a saw chain. The size of the chain may vary depending on the general use of the chainsaw, since commercial applications generally demand larger chains than home use. The guide bars of different chainsaws similarly vary in size and shape depending on the maximum size of the intended workpiece but oppositely directed surfaces of the guide bar on all sizes and makes are predictably parallel (for cutting purposes) and as I realize, ideal as clamping surfaces for the rule. In FIG. 1, the attachment includes support 5 having arms 6 and 7 which are positioned on opposite sides of guide bar 4 and are connected by drawing together means 8. Support 5 holds rule 9 substantially perpendicular to guide bar 4, which lies in the plane of sawing.

Figure 2:
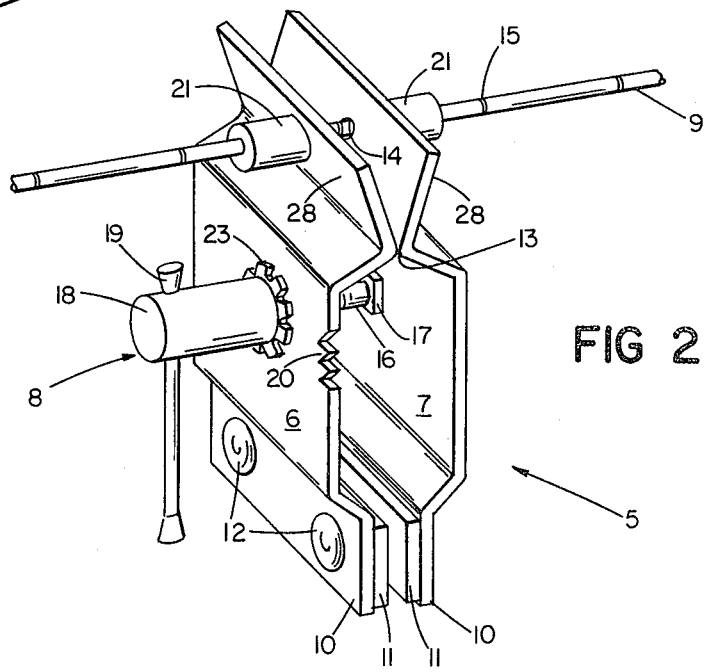
FIG. 2 is a perspective view of the preferred embodiment of the attachment.
Figure 3:
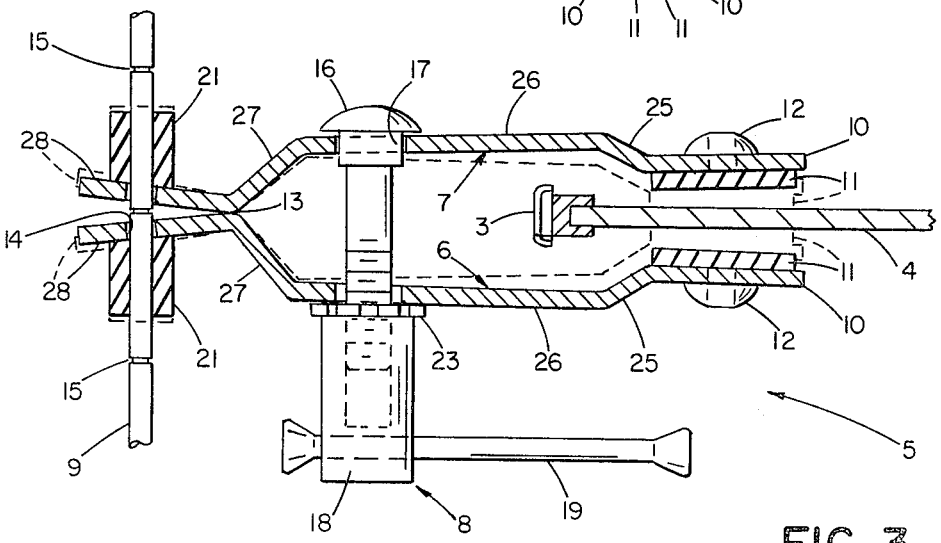
FIG. 3 is a side view of the attachment.

Turning to FIG. 2, arms 6 and 7 can be any suitable rigid material, preferably steel stampings. In FIG. 3, arms 6 and 7 can be identical stampings. Arms 6 and 7 are each formed to have a grip portion 10, an outwardly directed clearance portion 25, a clearance portion 26 which is parallel to grip portion 10, an inwardly directed portion 27 and a rule holding portion 28. The area of connection between the rule holding portion and the inwardly directed portion forms the fulcrum region 13. The perpendicular distance between the parallel clearance portion and the plane of the grip portion is sufficient to avoid interference with the chain, preferably at least ⅜". Resilient rubber pads 11 are attached to grip portion 10 by means of grommets 12 pushed through holes in arms 6 and 7. The surfaces of pads 11 contact the sides of guide bar 4 to prevent slippage. Arms 6 and 7 each have a fulcrum region 13 which bears against the other arm's fulcrum region, and rule holding portion 28 having rule hole 14 which is slightly larger than the diameter of rod-form rule 9, permitting rule 9 to be moved axially when the attachment is not clamped to the guide bar.

Returning to FIG. 2, rule 9 is a flexible, inexpensive replaceable rod of aluminum, fiberglass or another suitable material. Rule 9 may be of any desired length but lengths of slightly more than two feet or slightly more than four feet would be useful for normal home and commercial uses, respectively. Rule 9 need not have a round cross-section. Rule 9 bears marks 15 to indicate distances along the rod. Marks 15 can be inscribed or painted on the surface of rule 9 or applied in any other convenient fashion.

Drawing together means 8 includes carriage bolt 16 (having square shaft section 17 under its head) and hand nut 18. Square shaft section 17 locks into a square hole in arm 7 to prevent rotation of bolt 16. Other methods may be used to prevent rotation of bolt 16. Hand nut 18 is a steel cylinder having a threaded hole aligned with its axis. Lever 19 is slidably attached through hole 19 perpendicular to the axis of bolt 16 to provide leverage to permit nut 18 to be tightened securely by hand without the use of tools. Lock washer 23 prevents nut 18 from loosening. Nut 18 and drawing together means 8 could have any other configuration which permits the user to clamp support 5 securely to guide bar 4 without the use of tools.

Arms 6 and 7 and drawing together means 8 are arranged to avoid contact with chains of various sizes.

Arm 6 (and arm 7 if desired) has log spikes 20 formed in the edge facing the workpiece. The arms 6 and 7 can be identical with log spikes on each edge of portions 26, if desired.

Rubber sleeves 21 positioned on rule 9 against arms 6 and 7 further hold rule 9 securely in place.

Operation

In operation, hand nut 18 is withdrawn to a position which permits support 5 to be mounted over chain 3 and guide bar 4. Rod 9 is inserted through holes 14 and positioned with the desired mark 15 visible between the rule holding portions of arms 6 and 7, to provide the desired distance between the guide bar and one end of rule 9. Support 5 is then positioned close to motor housing 2 avoiding contact between support 5 and chain 3. Hand nut 18 is then tightened by hand to clamp arms 6 and 7 against guide bar 4, also causing holes 14 to bind against and hold rule 9 firmly in the desired position. Sleeves 21 are slid onto rule 9 and pushed against arms 6 and 7.

The user can then cut logs of the desired length by aligning the end of rule 9 with the end of the workpiece 22.

The attachment can be clamped to guide bar 4 with rule 9 either above or below guide bar 4, depending on the user's preference. Mounting the atttachment below guide bar 4 positions the end of rule 9 closer to workpiece 22 at the beginning of the cut and enables easier determination of the sawing point.

The user can measure to the right or to the left of the guide bar simply by moving rule 9 axially or alternatively by remounting support 5 with the positions of arms 6 and 7 reversed with respect to the plane of the guide bar.

Other Embodiments

Within the broader aspects of the invention other embodiments of quite different specific construction can be employed. For instance the support may take the form of a "U" shaped casting, constructed to straddle the bar without touching the chain, with one arm of the "U" positioning a stationary bar gripping surface at one face of the bar and the other arm carrying an adjustable threaded member much in the nature of a vice lead screw, adapted to forceably hold the gripping surface against the opposite face of the bar.

What is claimed is:

1. A chainsaw attachment for indicating a point at which to saw a workpiece relative to a second point on said workpiece, comprising a rule, and a support attachable to said chainsaw for holding said rule, said support being attachable to the guide bar of said chainsaw and comprising:

at least two arms, positioned on opposite sides of said guide bar, having opposed grip portions arranged to engage oppositely directed side surface portions of said guide bar, and means for drawing said grip portions together to tightly grip said guide bar between said grip portions and to locate a rule attachment means stably with respect to said guide bar, said rule attachment means being adapted to stably support said rule in a position substantially perpendicular to the plane of sawing with the end of said rule substantially opposite said second point on said workpiece, said arms, drawing together means, and rule attachment means being arranged to avoid contact with the chain of said chainsaw.

2. The attachment of claim 1 in which said two arms are formed independently of one another, each arm having said grip portion at one extremity and, at a remote point from said grip portion, a fulcrum region adapted to engage the fulcrum region of the other arm, said drawing together means comprise an adjustable clamping means operative between said grip portions and said fulcrum regions to draw said arms together causing said fulcrum regions to bear upon one another and said grip portions to tightly grip said guide bar, said clamping means being spaced from said grip portions to avoid contact of said clamping means with the chain of said chainsaw, and said arms being shaped to avoid contact with said chain when said arms are clamped to said guide bar.

3. The attachment of claim 2 in which said rule is axially movable, said rule attachment means comprises on each arm a rule holding portion located on the opposite end of said arm from said grip portion, said fulcrum region being located between said grip portion and said rule holding portion, said rule holding portion having a rule hole slightly larger than the cross-sectional dimension of said rule, the axis of said rule hole being substantially in line with the axis of the rule hole in the other arm when said arms are clamped to said guide bar, said arms, said rule and said drawing together means being so arranged that when said arms are drawn together, said fulcrum regions bear upon one another, said grip portions tightly grip said guide bar, and said rule holding portions are spread apart causing the perimeters of said rule holes to bind against the surface of said rule thereby holding said rule securely in a selected position.

4. The attachment of claim 2 or 3 in which each of said arms is contoured with said grip portion having a substantially flat surface lying substantially parallel to the plane of said guide bar, a first clearance portion connected to and outwardly directed from said grip portion, a second clearance portion, connected to said first clearance portion and lying substantially parallel to said grip portion at a perpendicular distance of at least $\frac{3}{8}''$ from the plane of said flat surface, a third clearance portion, connected to and inwardly directed from said second clearance portion, and a rule holding portion connected to said third clearance portion and lying at a small angle to the plane of said flat surface, such that the area of connection between said third clearance portion and said rule holding portion forms said fulcrum region, said contour being arranged to provide clearance space between said arm and the chain of said chainsaw.

5. The attachment of claim 1, 2 or 3 in which said drawing together means comprises a carriage bolt passing through substantially colinear holes in said arms, a hand nut screwed onto the threads of said bolt, and a lock washer positioned between said hand nut and one of said arms, so arranged to permit said attachment to be securely clamped to said guide bar by hand tightening of said hand nut.

6. The attachment of claim 3 in which said rule bears at least one mark to indicate distance along the axis of said rule, said mark being visible between said rule holding portions of said arms when the position of said rule is appropriately selected and said attachment is clamped to said guide bar, said arms being so arranged that when said mark is visible between said rule holding portions, said mark lies substantially within the plane of sawing.

7. The attachment of claim 3 further comprising at least one sleeve which can be tightly held on said rule in a position bearing against at least one of said arms to further hold said rule securely in the selected position.

8. The attachment of claim 1, 2 or 3 further comprising at least one resilient, slip-resistant pad attached to the grip portion of each of said arms for contacting the side of said guide bar to enable tighter slip-free clamping of said attachment to said guide bar.

9. The attachment of claim 1, 2 or 3 further comprising spikes on the edge of at least one of said arms facing said workpiece to provide a pivot point against said workpiece to aid in finishing a saw cut.

* * * * *